US010180309B1

(12) United States Patent
Burke

(10) Patent No.: US 10,180,309 B1
(45) Date of Patent: Jan. 15, 2019

(54) ELECTROMAGNETIC PULSE TRANSMITTER MUZZLE ADAPTOR

(71) Applicant: The United States of America as Represented by the Secretary of the Army, Washington, DC (US)

(72) Inventor: James E. Burke, Oak Ridge, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 74 days.

(21) Appl. No.: 15/205,211

(22) Filed: Jul. 8, 2016

Related U.S. Application Data

(63) Continuation-in-part of application No. 14/487,205, filed on Sep. 16, 2014, now abandoned.

(51) Int. Cl.

| | |
|---|---|
| ***F41H 13/00*** | (2006.01) |
| ***H01Q 13/02*** | (2006.01) |
| ***H01Q 1/52*** | (2006.01) |
| ***H01Q 5/25*** | (2015.01) |

(52) U.S. Cl.
CPC ..... *F41H 13/0075* (2013.01); *H01Q 1/526* (2013.01); *H01Q 5/25* (2015.01); *H01Q 13/02* (2013.01)

(58) Field of Classification Search
CPC .. F41A 5/18; F41A 19/30; F41A 21/38; F41A 3/26; F41A 5/30; F41A 15/12; F41A 19/58; F41A 19/60; F41A 19/59; F41A 19/63; F41A 19/64; F41A 19/68; F41A 19/69; F41A 27/28; F41H 13/0075; F41H 13/0093; G01S 7/495
See application file for complete search history.

(56) References Cited

U.S. PATENT DOCUMENTS

| | | | | |
|---|---|---|---|---|
| 2,398,642 A * | 4/1946 | Homrighous | H04N 5/06 | 313/365 |
| 2,407,065 A * | 9/1946 | Jensen | H01Q 19/06 | 333/24 R |
| 2,472,136 A * | 6/1949 | Whitlock | F41A 17/08 | 342/45 |
| 3,102,553 A * | 9/1963 | Ottestad | F16K 17/10 | 137/505.13 |
| 3,125,733 A * | 3/1964 | Holinbeck | H01P 3/00 | 102/206 |
| 3,257,905 A * | 6/1966 | Weisman | F42D 1/04 | 290/1 R |

(Continued)

OTHER PUBLICATIONS

Max Teodorescu, US Army devises electricity cannon attachment for the M4 rifle—fries enemy electronics , Apr. 24, 2015, Electronic Products, https://www.electronicproducts.com/Military/Weapons/US_Army_devises_electricity_cannon_attachment_for_the_M4_rifle_fries_enemy_electronics.aspx, pp. 1-2.*

*Primary Examiner* — Troy Chambers
*Assistant Examiner* — Bridget A Cochran
(74) *Attorney, Agent, or Firm* — Michael C. Sachs

(57) ABSTRACT

A one man portable electromagnetic pulse transmitter includes a standard rifle having a muzzle and capable of firing a blank cartridge containing propellant. A blank firing adapter is fixed to the muzzle of the rifle. A piezolectric generator is aligned with the gas exit orifice of the blank firing adapter. An antenna is electrically connected to the piezolectric generator and an electromagnetic shield is disposed between the antenna and the piezolectric generator.

12 Claims, 4 Drawing Sheets

(56) References Cited

U.S. PATENT DOCUMENTS 3,466,761 A * 9/1969 Stinchcomb ..... F41G 3/32 398/107
3,573,676 A * 4/1971 Mayer ..... H01B 11/12 178/45
3,636,390 A * 1/1972 Stauder ..... F42C 11/04 290/1 R
3,746,881 A * 7/1973 Fitch ..... H03K 3/537 307/108
3,922,968 A * 12/1975 Conger ..... F42B 12/36 102/207
3,973,500 A * 8/1976 Brede ..... F42C 11/04 102/209
4,738,411 A * 4/1988 Ahlstrom ..... F41G 3/145 244/3.15
4,845,378 A * 7/1989 Garbe ..... H01T 1/00 307/106
5,818,132 A * 10/1998 Konotchick ..... H02K 35/02 310/17
6,322,365 B1 * 11/2001 Shechter ..... F41A 33/02 434/19
6,477,932 B2 * 11/2002 Jung ..... F41H 13/0068 89/1.11
6,744,154 B2 * 6/2004 Leitner-Wise ..... H02K 7/1869 290/1 R
6,856,238 B2 * 2/2005 Wootton ..... F41A 17/063 340/10.1
7,111,559 B1 * 9/2006 MacLachlan ..... F41H 11/08 102/502
7,560,855 B2 * 7/2009 Baird ..... H02N 2/183 310/339
7,690,288 B2 * 4/2010 Calico ..... F42C 11/02 102/210
8,205,555 B1 * 6/2012 Rastegar ..... D21F 1/0027 102/210
9,391,596 B2 * 7/2016 Campbell ..... H03K 3/012
2009/0108845 A1 * 4/2009 Kaminski ..... G01V 3/082 324/337
2013/0145670 A1 * 6/2013 Kuhlman ..... F41A 19/59 42/84

* cited by examiner

ELECTROMAGNETIC PULSE TRANSMITTER MUZZLE ADAPTOR

This application is a continuation in part of application Ser. No. 14/487,205 filed Sep. 16, 2014 by the same inventor and commonly assigned, which complete parent application file wrapper contents are hereby incorporated by reference as though fully set forth.

STATEMENT OF GOVERNMENT INTEREST

The inventions described herein may be manufactured, used and licensed by or for the United States Government.

BACKGROUND OF THE INVENTION

The invention relates in general to directed energy weapons and in particular to electromagnetic pulse weapons.

Directed energy weapons, such as electromagnetic pulse weapons, can be used to disrupt or destroy electronic devices. The targeted electronic devices may be, for example, communications equipment; vehicle engine control units installed in land, sea or air vehicles; weapon fire control systems; or other electronic devices. The principal problem with known directed energy weapons is their large size. The large size stems from either a large power source or a large radiating element, or both. The structure of the radiating element or antenna is related to the frequency of the directed energy. Known directed energy weapons are so large that often a vehicle is required to tow them to the area of use. Towing the directed energy weapon with a vehicle is not always desirable because it requires manpower, fuel and time to transport, setup and operate the weapon system.

A need exists for an inexpensive, one man portable directed energy weapon.

SUMMARY OF INVENTION

One aspect of the invention is an electromagnetic pulse gun that includes a rifle with a muzzle. The rifle is capable of firing a blank cartridge containing propellant. A blank firing adapter is fixed to the muzzle of the rifle. The blank firing adapter includes an axial gas exit orifice. A ferroelectric generator is aligned with the gas exit orifice. An antenna is electrically connected to the ferroelectric generator. An electromagnetic shield is disposed between the antenna and the ferroelectric generator.

The gun includes a housing for the ferroelectric generator and the housing is fixed to the blank firing adapter.

A voltage amplifier circuit may be electrically connected to the ferroelectric generator and the antenna.

A passive circuit may be electrically connected to the voltage amplifier circuit and the antenna.

The antenna may be a quasi-TEM horn antenna.

Another aspect of the invention is a method of radiating a pulse of electromagnetic energy. The method includes providing a novel electromagnetic pulse gun and firing a blank firing cartridge in a rifle that is part of the novel gun. An electric pulse is generated from a ferroelectric generator using propellant gas generated by firing the blank firing cartridge. The electric pulse is sent to an antenna and electromagnetic energy is radiated by the antenna.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel electromagnetic pulse (EMP) gun uses the explosive pulse power from a blank firearm cartridge to supply mechanical force to a ferroelectric element. The blank firearm cartridge may be fired from, for example, a rifle. The rifle may be an unmodified standard issue U.S. Army M4 5.56 mm caliber rifle. Other calibers of rifles may also be used. A blank firing adapter (BFA) is attached to the muzzle of the rifle. The ferroelectric element transforms the mechanical energy created by firing the blank cartridge to an electrical pulse of energy. The electrical pulse of energy is radiated by an antenna. The electromagnetic radiation is transient and includes a band of frequencies simultaneously. The electromagnetic pulse is an ultra-wide band (UWB) pulse directed in a coherent direction with high power.

Figure 1:
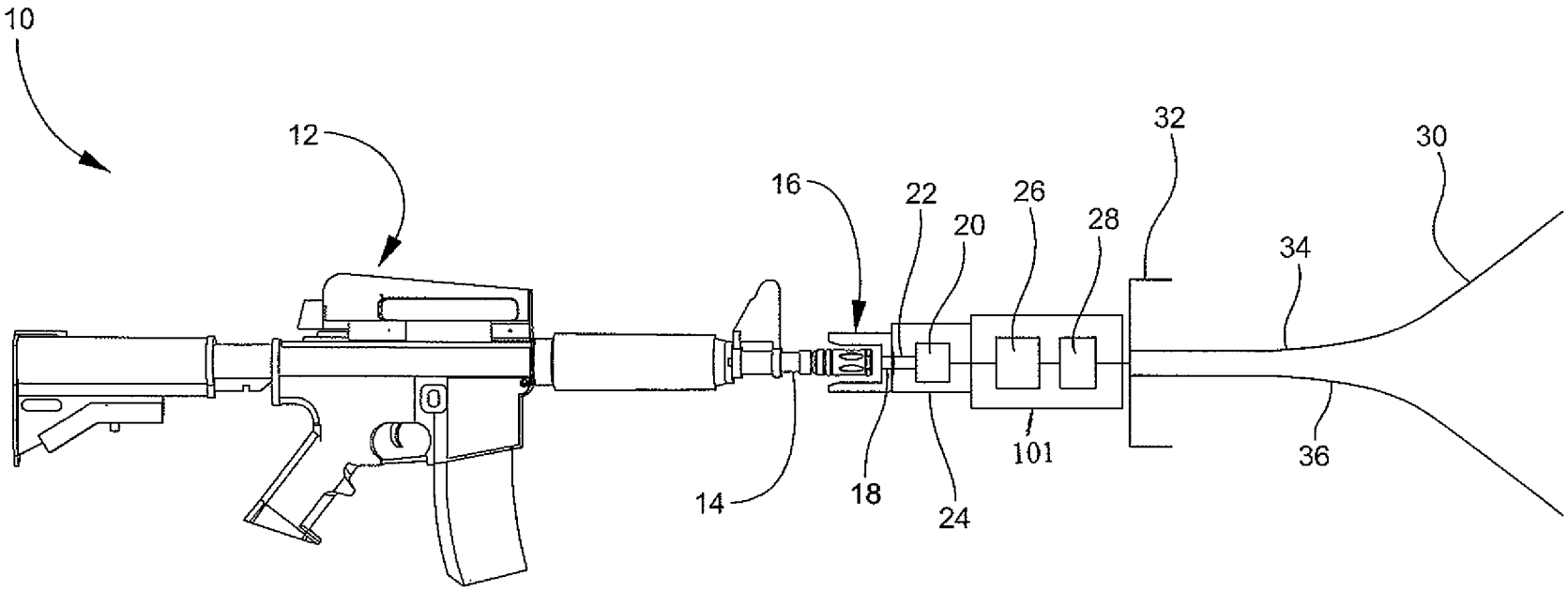
FIG. 1 is a schematic of one embodiment of an electromagnetic pulse gun.
Figure 2:
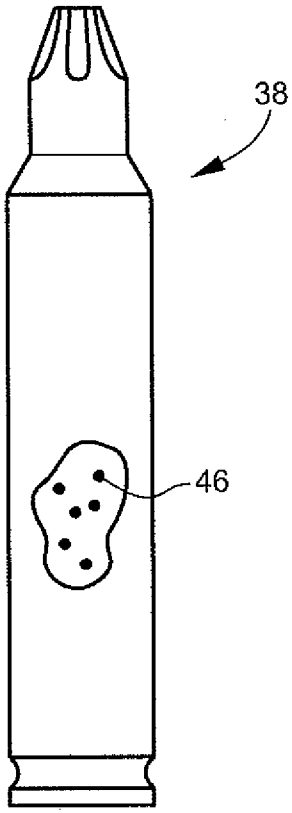
FIG. 2 is a side view, partially cut away, of one embodiment of a blank firearm cartridge.

FIG. 1 is a schematic of one embodiment of an EMP gun 10. Gun 10 includes a rifle 12, for example, a standard issue military rifle or a commercial off-the-shelf rifle. The muzzle 14 of rifle 12 is fitted with a blank firing adapter (BFA) 16. The BFA 16 has a hole or orifice 18 on its axial centerline for release of high pressure propellant gas. The size and shape of orifice 18 may be designed to tailor the gas pressure and flow for optimum electrical power generation. A radial gas port (not shown) in the BFA 16 is formed perpendicular to the axial centerline to release the propellant gas after the electrical pulse has been generated. A blank firearm cartridge 38 (FIG. 2) containing propellant 46 may be fired in rifle 12 to generate high pressure propellant gas.

Downstream of the BFA 16 is a ferroelectric generator 20. Generator 20 is mounted in a ferroelectric housing 24. Housing 24 may be directly fixed to BFA 16 by, for example, welding. Housing 24 includes an opening 22 in fluid communication with orifice 18 of BFA 16. In one embodiment, generator 20 includes multiple ferroelectric elements. Multiple ferroelectric elements may be electrically connected in series in housing 24. Each ferroelectric element may be a multi-stacked generator. By way of example only, a ferroelectric element having a 6 mm diameter and a 2.8 mm thickness can produce 12.53 mJ of energy at a maximum pressure of 15,000 psi.

The electrical output of the ferroelectric generator 20 may be amplified by a known voltage amplifier circuit 26. A passive circuit 28 may be used to modify the electrical pulse length. The passive circuit 28 sharpens the rise time of the electrical pulse created by ferroelectric generator 20. The pulse waveform is a sharp rise pulse with an exponential decay. Known passive circuits may be used to create the pulse waveform, for example, a step recovery diode may be used to sharpen the pulse, and a capacitor and an inductor (both in parallel with the step recovery diode) may be used to control the decay rate of the pulse.

The electrical output from the generator 20 via optional circuits 26, 28 is fed to an antenna 30. A back plate or shield 32 is provided behind antenna 30. The thickness of shield 32 depends on the band of frequencies used. Shield 32 is electrically disconnected so that it will not radiate. Antenna 30 is, for example, a quasi-TEM horn antenna or a UWB high directional antenna. Antenna 30 may include two metal plates 34, 36 that each has an exponential curve, such as a parabolic curve. Plates 34, 36 are initially parallel before curving into a horn shape.

Figure 3:
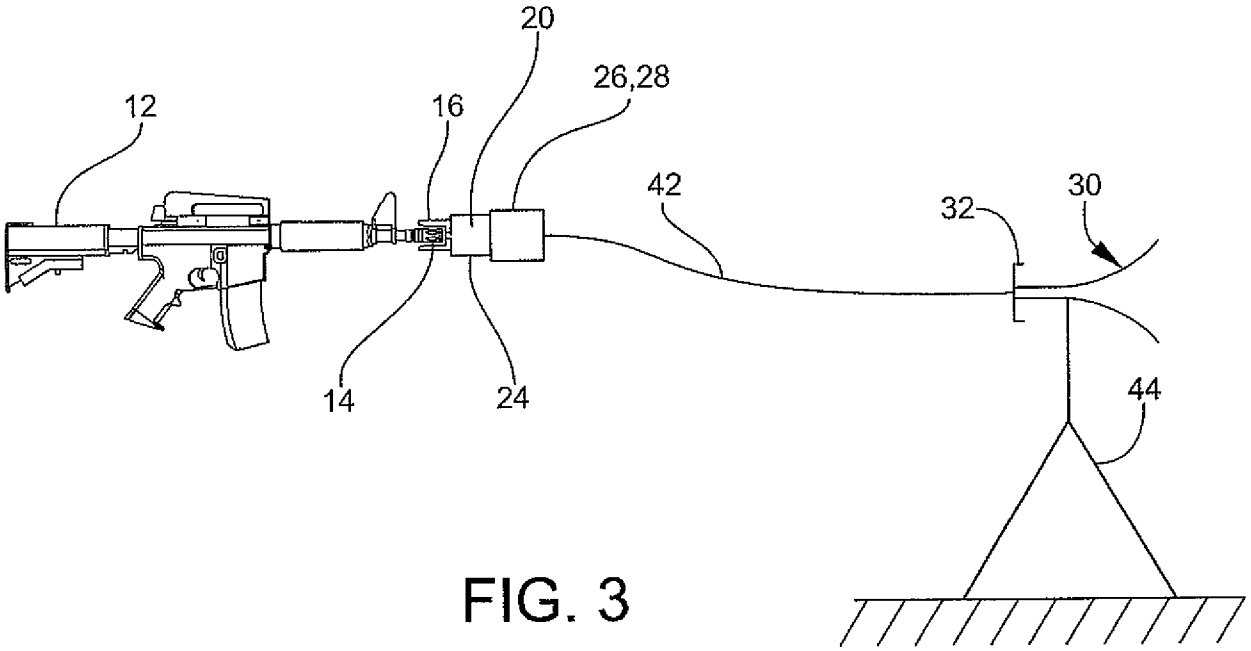
FIG. 3 is a schematic of another embodiment of an electromagnetic pulse gun.
Figure 4:
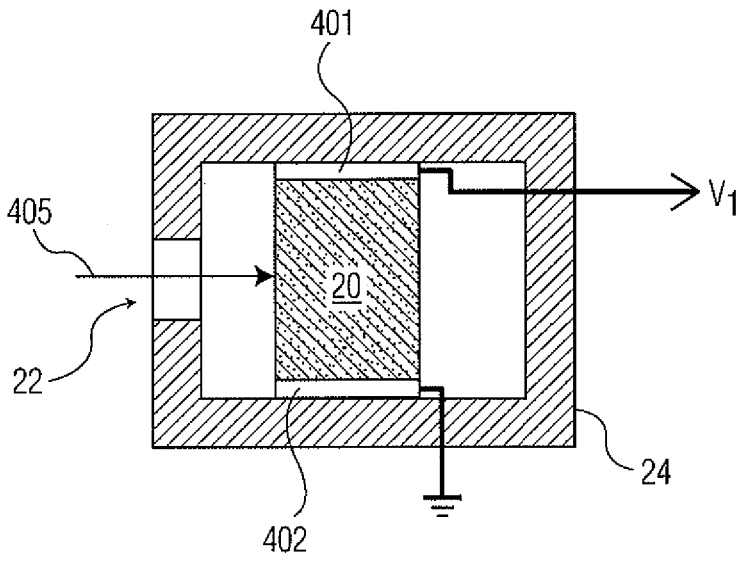
FIG. 4 is a cross sectional view of piezoelectric element within housing 24.
Figure 5:
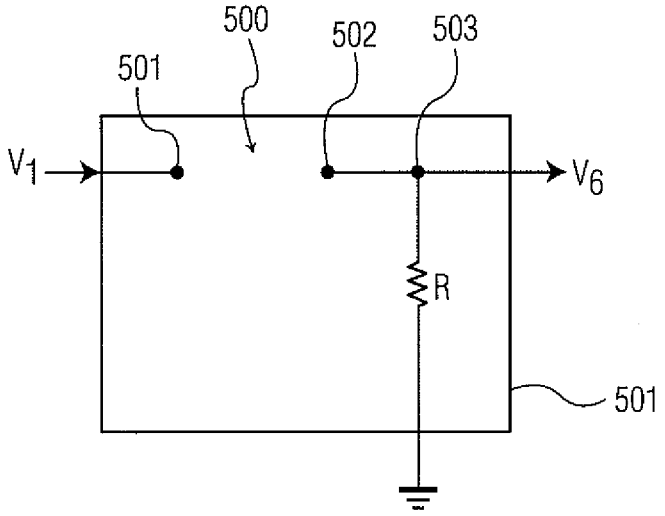
FIG. 5 is a schematic of a spark gap device for this invention.
Figure 6:
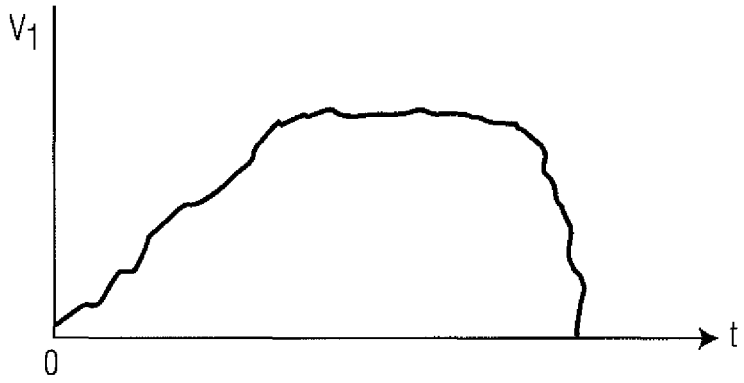
FIG. 6 is a hypothetical signal output from the piezoelectric elements.
Figure 7:
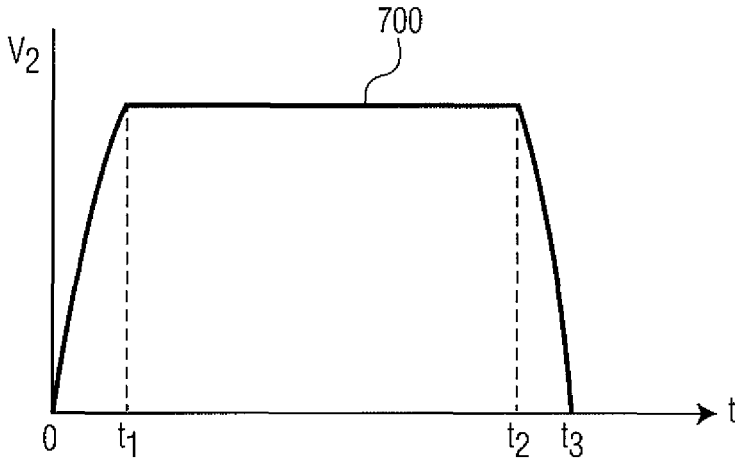
FIG. 7 is a hypothetical signal output from the spark gap device.

EMP gun 10 is one man portable. Preferably, EMP gun 10 weighs no more than 31 pounds. FIG. 3 is a schematic of an alternate, optional arrangement of an EMP gun 40. In gun 40, the shield 32 and antenna 30 are spaced apart from ferroelectric generator 20 and circuits 26, 28. Antenna 30 is connected to generator 20 or circuits 26, 28 using a cable 42. Shield 32 and antenna 30 may be supported by a stand, for example, a tripod 44. In FIG. 1, high pressure gases leave the BFA through hole 18 which is directly aligned with opening 22 in housing 24 (see also FIG. 4) to directly input the BFA's high pressure gases directly and fully into opening 22. The BFA is attached to housing 24 (welded perhaps in some embodiments). The BFA might even have a small pipe (not shown) to feed its output pressure gases directly into housing 24 through hole 22, to strike piezoelectric element 20 therein (also referred to within as a PEG). Pressure exerting onto the PEG could range from 5 kPSI to 12 kPSI, depending on the type of rifle or other weapon being used. The size of hole 22 leading onto the PEG could be roughly 3 mm in diameter. One type of PEG to employ could be a piezoelectric element number EC-64 from Exelis Incorporated or Harris Corporation. This component is made using a material called PZT, (Lead Zirconate Titanate), an electroceramic material. The output voltage of the piezoelectric generator (PEG) could be approximately 30 kV. Arrow 405 illustrates gases symbolically being forced into housing 24 to strike piezoelectric element 20. In housing 24, the piezoelectric element 20 is bounded by two metal plates 401 and 402 where a voltage appears when pressure is applied to piezoelectric element 20. Voltage V1 which may be generated from the piezoelectric element 20 is shown in FIG. 6. Voltage V1 is fed to housing 501 for processing into a more even pulse like formation V2 in FIG. 7, which pulse has a much steeper rise time and a flatter duration than in FIG. 6, e.g. It was suggested that this pulse transformation be done in housing 101 of FIG. 1 by elements 26 and 28. Such amplifier and passive circuits as 26 and 28 are examples of the type of devices that are in the category of pulse forming network circuits. These could be implemented completely by a Pomona electronic box model number 2901 with cover. However, a method here is shown otherwise by a spark gap component (FIG. 5) to accomplish these very same objectives. Output voltage V2 (going to the antenna horn 30, e.g.) after exiting this FIG. 5 spark gap, can be roughly 22 kV, and duration of this pulse can vary from 1.7 ms to 2.9 ms (depending on voltages as may have been output from the PEG). Here, voltage V1 is fed into spark gap 500 and as it eventually jumps the gap between points 501 and 502, so that a voltage V2 can appear at point 503. The distance across the spark gap may be 7 mm for example. From here, the voltage would eventually variously dissipate through various elements of the entire system (symbolically represented by some unspecified resistance R), however, V2 can be tapped at 503 as the desired output voltage V2 which could be used to feed the horn antenna, as was mentioned. This invention may employ N-type connectors on all subcomponents in the system.

While this invention may be employed as an electromagnetic pulse gun, it should more generally be seen as a system that converts an existing barrel of a gun into an electromagnetic pulse weapon. The barrel of the existing gun can be of any caliber from M4 rifle (which may have been shown in the Figures), to .50 caliber rifles, and possibly even tank gun barrels. It provides an explosive pulse power generator. A system here is being shown of electrically connecting an explosive pulse power generator, a pulse forming network circuit, and a radiating antenna together to physically connect to a barrel plug/gas transport component. The barrel plug/gas transport device as was mentioned, plugs the rife at the muzzle. Such barrel plug/gas transport could be implemented by a blank firing adaptor (BFA) with a through-hole, as were shown in FIGS. 1 and 3 for example. An explosive pulse power generator can be implemented variously but is not necessarily limited to a piezoelectric generator. A pulse forming network circuit example can be implemented, but is not necessarily limited to, a spark gap such as in FIG. 5, and a radiating antenna example can be implemented, but is not necessarily but not limited to, a TEM parallel-plate type horn antenna. A sequence of invention operation as was mentioned, could be described by: A BFA with a through-hole is used to plug the muzzle of a similar caliber rifle barrel. A piezoelectric generator component is mounted onto the BFA. A spark gap is mounted onto the piezoelectric generator. A TEM horn antenna is then mounted to the spark gap. A blank ammunition, similar to the caliber rifle, is loaded into the rifle. When the ammunition is ignited through pulling the trigger of the existing rifle, the high pressure gases pass the through-hole of the BFA to exert force onto the surface of the piezoelectric element. Inside the piezoelectric generator housing, the piezoelectric element converts this mechanical energy into electrical energy. The electrical voltage of such energy's pulse enjoys a sharper rise time after traversing the breakdown voltage of the spark gap. Finally, the pulse signal transmits electromagnetically through the horn antenna to disrupt or damage electronic threats. Electronic threats might be defeated in one of many ways for example by virtue of having an electric field magnitude emitted from the horn antenna of this invention couple into a circuit or electrical component in the threat device, in which, such circuit or electrical component thus becomes exposed to a current or voltage that is beyond the rating of that circuit or electrical component.

While the invention has been described with reference to certain embodiments, numerous changes, alterations and modifications to the described embodiments are possible without departing from the spirit and scope of the invention as defined in the appended claims, and equivalents thereof.

What is claimed is:

1. An electromagnetic pulse transmitter, comprising:

a rifle having a muzzle and capable of firing a bank cartridge containing propellant;

a blank firing adapter fixed to the muzzle of the rifle, the blank firing adapter including an axial gas exit orifice;

a piezolectric generator aligned with the gas exit orifice, wherein the piezolectric generator includes multiple ferroelectric elements;

an antenna electrically connected to the piezolectric generator; and an electromagnetic shield disposed between the antenna and the piezolectric generator, and wherein the transmitter further comprises a housing wherein the piezolectric generator is mounted in the housing and the housing is fixed to the blank firing adapter, and wherein said transmitter further comprises a spark gap device electrically connected between the piezolectric generator and the antenna.

2. The transmitter of claim 1, wherein the antenna is a quasi-TEM horn antenna.

3. The transmitter of claim 1, wherein the antenna is an ultra-wide band directional antenna.

4. An electromagnetic pulse transmitter, comprising:

a rifle having a muzzle and configured to fire a blank cartridge containing propellant;

a blank firing adapter fixed to the muzzle of the rifle, the blank firing adapter including an axial gas exit orifice;

a housing fixed to the blank firing adapter;

at least one piezolectric generator disposed in the housing and aligned with the gas exit orifice;

a quasi-TEM horn antenna electrically connected to the at least one piezolectric generator; and an electromagnetic shield disposed between the quasi-TEM horn antenna and the at least one piezolectric generator.

5. The transmitter of claim 4, further comprising a spark gap device electrically connected between the piezolectric generator and the quasi-TEM horn antenna.

6. The transmitter of claim 5, wherein the rifle is a 5.56 mm caliber rifle.

7. The transmitter of claim 6, wherein the gun is one man portable.

8. The transmitter of claim 1, wherein the transmitter weighs no more than 31 pounds.

9. The transmitter of claim 5 the spark gap is 7 mm, and where the output voltage of the spark gap is 22 kV of duration 1.7 ms to 2.9 ms, which is fed to the horn.

10. The transmitter of claim 4 further including a Pomona electronic box 2901 pulse forming network electrically connected between the piezolectric generator and the quasi-TEM horn antenna.

11. The transmitter of claim 4 wherein the gas exit orifice is 3 mm, where the output pressure out of the orifice is 5 kPSI to 12 kPSI which then is exerted upon the piezoelectric generator.

12. The transmitter of claim 4 the piezoelectric generator is an Exelis/Harris EC-64 where the output voltage from the piezoelectric generator is 30 kV.

* * * * *